United States Patent [19]

Shimenkov et al.

[11] 4,227,536

[45] Oct. 14, 1980

[54] ARTICLE IMITATING A PART OF A WOMAN'S BREAST

[76] Inventors: Marat Shimenkov, 65-46 Parsons Blvd., Apt. 2A, Flushing, N.Y. 11365; Abraham Froyman, 110-20 Flave Apt. 308, Forest Hills, N.Y. 11375

[21] Appl. No.: 18,461

[22] Filed: Mar. 7, 1979

[51] Int. Cl.[3] ..... A41C 3/10; A61F 1/00

[52] U.S. Cl. ..... 128/479; 128/481; 3/36

[58] Field of Search ..... 3/36, 1; 128/462, 478–481, 128/425, 463, 461

[56] References Cited

U.S. PATENT DOCUMENTS

| | | | |
|---|---|---|---|
| 2,108,205 | 2/1938 | Martin | 3/36 |
| 2,289,679 | 7/1942 | Porter | 128/481 |
| 3,285,247 | 11/1966 | Morin | 3/36 X |
| 3,401,407 | 9/1968 | Pittman | 3/36 |
| 3,976,083 | 2/1975 | Schmidt | 128/425 |

*Primary Examiner*—Ronald L. Frinks

*Attorney, Agent, or Firm*—Ilya Zborovsky

[57] ABSTRACT

An article imitating a part of a woman's breast has a body portion which is formed as a convex body and has a convex front surface, a rear surface and an axis. An insert is embedded in the body portion and movable between a position in which the body portion extends in the direction of the axis and the axis is located normal to the rear surface, and another position in which the axis of the body portion extends at an angle to the rear surface. The insert may be formed by one or several pins which can be bent and retain their shape in the bent condition. The body portion may be provided with a part forming an areola around the body portion which later imitates a woman's nipple. The body portion together or without the areola may be attached to a brassiere.

12 Claims, 9 Drawing Figures

ARTICLE IMITATING A PART OF A WOMAN'S BREAST

BACKGROUND OF THE INVENTION

The present invention relates to an article imitating a part of a woman's breast, or more particularly a woman's nipple.

It is well known that women pay special attention to their appearance and particularly to those parts of the body which is characteristic for their sex. This is especially true with respect to woman's breast and a nipple which is a part of the latter. In many cases, however, the nipple is underdeveloped or changed with age so that it does not have its natural shape and dimensions. Women with such nipples feel inferior and unattractive for men. Moreover, even women with normally developed nipples frequently want to make them bigger so that the contours of the nipples be visible under the clothes. Increase of the dimensions of the nipples with use of drugs or other methods are health hazardous and difficult. It is also important to have such a nipple whose direction of extension can be adjusted. Some women feel that the nipples which are directed somewhat upwardly are more attractive. Other women consider to be attractive nipples which are directed somewhat laterally outwardly in opposite lateral directions. Women's taste for this depends mainly on their experience, or more particularly on the fact how their nipples extend in young age. Thus, a possibility to adjust the direction in which nipples extend is to be considered also very attractive to women in order to satisfy their specific requirements made to such an article.

SUMMARY OF THE INVENTION

Accordingly, it is an object of the present invention to provide an article imitating a nipple of a woman's breast which avoids the disadvantages of the prior art.

More particularly, it is an object of the present invention to provide an article imitating a nipple which is adjustable in response to user's desire to make it extending in a predetermined direction.

In keeping with these objects and with others which will become apparent hereinafter, one feature of the present invention resides, briefly stated, in an article which has a body portion having a convex front surface, a rear surface, and an axis, and an insert embedded in the body portion and movable so that it urges the body portion to a first position in which the axis of the latter extends normal to the rear surface, and another position in which the axis of the body portion extends at an angle to the rear surface. The insert is also operative for retaining the body portion in each of these positions.

An article which is constructed in accordance with the present invention eliminates the above mentioned disadvantages of the prior art. The body portion imitating a natural nipple can be adjusted so that it can extend at any angle to its rear surface or in other words, to a woman's breast when the thus formed artificial nipple is fixed adjacent to the woman's breast.

The insert may be formed as one or several pins, for example of metal, in the case when the body portion is solid, or extends in a thin wall of the body portion in the case when the latter is hollow.

The novel features which are considered as characteristic for the present invention are set forth in particular in the appended claims. The invention itself, however, both as to its construction and its method of manufacture will be best understood from the following specification and description when read in connection with the accompanying drawings.

DESCRIPTION OF PREFERRED EMBODIMENTS

Figure 1:
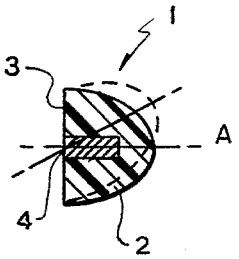
FIG. 1 is a view showing a solid article in accordance with one embodiment of the present invention.

An article imitating a nipple of a woman's breast is identified in toto by reference numeral 1. It has a rear surface 3 which is use faces toward a woman's breast, and a convex surface 2 which is use faces away from the woman's breast. The convex surface is so shaped as to have resemblance with a natural shape and dimensions of a natural nipple. The article or more particularly, a body portion thereof bounding by the above-mentioned rear surface 3 and front surface 2, has an axis which is identfied by reference letter A.

As can be seen particularly from FIG. 1, the body portion may be solid. An insert 4 is embedded in the solid body portion. The insert is so selected that it satisfies the requirements that it must be bendable and in bent conditions it must retain its shape temporarily until it is again bent by a user. In keeping with these objects, the insert 4 may be constituted, for example by a metallic wire of a predetermined cross sectional area. The cross section of the insert 4 is not important, and it may be square, round and the like. As can be seen from this FIG., the insert may extend from the rear surface 3 so as to have a free end at this surface. At the same time, the insert 4 may terminate shortly before the front surface 2, or more particularly before a forwardmost section of the latter. The body portion, in turn may be constituted by a synthetic plastic material, such as rubber. The requirements which are made to the material of the body portions is that it must be resilient so that under the action of bending of the insert 4 it is also bent. On the other hand the material of the body portion must be sufficiently soft so as not to offer great resistance to bending of the insert 4, and after bending not to straighten the insert 4.

In the position which is illustrated in solid lines in FIG. 1, the axis of the body portion extends substantially normal to the rear surface 3 thereof. As shown in dotted lines in the same FIG., the insert 4 may be bent so that the axis of the body portion extends at an angle to the rear surface 3. Thus, a user can adjust the direction in which the body portion extends in accordance with her desire.

Figure 2:
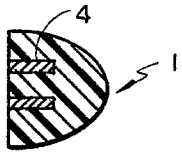
FIG. 2 shows a solid article in accordance with another embodiment of the invention.

FIG. 2 shows a further embodiment of the solid body portion. Several inserts 4, for example two or three inserts 4 may be embedded into the body portion. The number of the inserts and their cross section is selected so as to satisfy the above mentioned requirements. They must be bendable and at the same time retain their shape after bending. Several inserts are somewhat advantageous inasmuch as in this case each individual insert can be thinner, and thereby the nipple provided with the thinner inserts is softer than the nipple provided with one thick insert.

Figure 3:
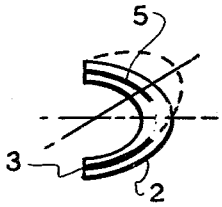
FIG. 3 is a view showing a hollow article in accordance with one embodiment of the invention.
Figure 4:
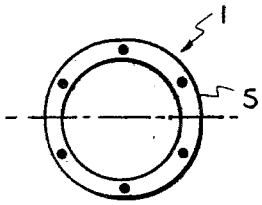
FIG. 4 is a view showing a hollow article in accordance with the embodiment of FIG. 3 in rear plan view.
Figure 5:
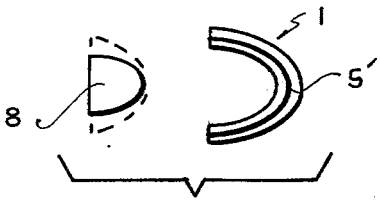
FIG. 5 shows the hollow article in accordance with another embodiment.

FIG. 3 shows a hollow body portion having a circumferential wall bounding an inner hollow. A plurality of inserts 5 may be embedded in the wall of the hollow body portion. This can also be clearly seen from FIG. 4 wherein the inserts 5 are circumferentially spaced from one another. The nipple or article in accordance with the present embodiment can not only be inclined to the rear surface 3, but also can change its dimensions. When the article is squeezed inwardly toward the axis, the body portion will be longer and narrower as shown in dotted lines in FIG. 5. Thus, the shape and dimensions of the article are also adjustable in this case. As shown in FIG. 5, the plurality of individual inserts 5' can be connected with each other so as to form a dome-shaped reinforcement adjustable due to the bending properties of the inserts.

Figure 6:
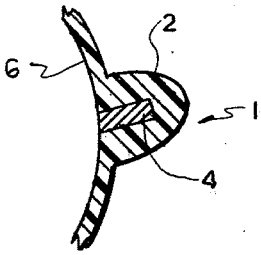
FIG. 6 shows the article provided with a part forming an areola.

FIG. 6 shows the body portion which is provided with an additional part 6. The part 6 is formed so as to imitate a natural areola of a woman's breast. In this case the above mentioned adjustment of the angle of inclination of the axis relative to the rear surface is performed also relative to a rear surface of the part 6. This is true since the rear surface of the additional part 6 forms an extension of the rear surface of the body portion itself. Simply speaking, in this construction, the body portion of the article can be inclined at different angles to the areola-forming part 6.

The body portion may be constructed in variety of modifications. The body portion shown in FIG. 3 is hollow. The body portion may also be hollow and closed from the rear side so as to form all-sidedly closed container. Such a container may be empty or filled with air or liquid. The body portion may be formed as an ornamental element, such as a head of an animal, a berry and the like.

Figure 7:
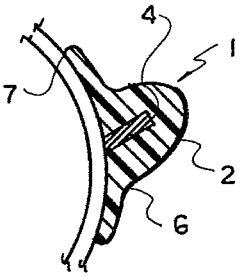
FIGS. 7 and 8 show attachement of the article to a brassire.
Figure 8:
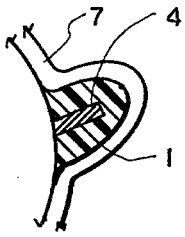

The body portion may be provided with means for fixing the same in the region adjacent to a user's breast. Such means may be formed as mounting strips, a harness and the like. As can be seen from FIGS. 7 and 8, the body portion may also be attached to a cup-shaped portion of a brassire 7. The article of FIG. 7 is provided with the areola forming part 6 and attached to an outer surface of the brassire, for instance by sewing, glueing, welding, tieing and the like. The article of FIG. 8 is not provided with the part 6 and is located inside the brassiere so as to bulge a portion of the latter to thereby imitate a woman's nipple. The body portion may be attached to the brassire by a plurality of methods which do not form a part of the present invention and for this reason are not disclosed in detail.

In accordance with the main concept of the invention, the body portion is adjustable relative to the cup-shaped portion of the brassire so that the body portion may extend normal to the surface of the latter or inclined at any desirable angle. to the same.

Figure 9:
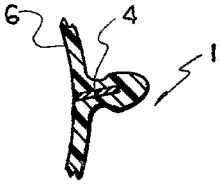
FIG. 9 is a further embodiment of the invention.

A plurality of spreading or expander members 8 may be further provided. They may have differing dimensions so that the expander member of desired dimension can be selected and inserted into the hollow body portion shown in FIG. 5 or even in a solid body portion which for these purposes must be provided with at least a small indentation. Thus, the size of the article may be adjusted in accordance with the desire of a user. A bottom section of the body portion (FIG. 9) may have a smaller cross section so that it is easier to be bent so as to assume an angle.

It will be understood that each of the elements described above, or two or more together, may also find a useful application in other types of constructions differing from the types described above.

While the invention has been illustrated as embodied in specific constructions of articles imitating a woman's nipple, it is not intended to be limited to details shown, since various modifications and structural changes may be made without departing in any sense from the spirit of the present invention.

Without further analysis, the foregoing will so fully reveal the gist of the present invention that others by applying current knowledge can readily adapt it for various applications without omiting features which, from the standpoint of prior art, fairly constitute essential characteristics of the generic and specific aspects of the present invention.

What is claimed as new and desired to be protected by Letters Patent is set forth in particular in the appended claims:

1. An article imitating a woman's nipple, comprising a deformable body portion having a rear surface arranged to face toward a user's breast, a convex front surface arranged to face away from the same, and an axis; and an insert embedded in said body portion and movable between at least two stable positions while remaining embedded in said body portion in which said insert and thereby said body portion surrounding said insert assume differing positions relative to said rear surface.

2. An article as defined in claim 1, wherein said insert is bendable so that in one of said positions said axis of said body portion extends substantially normal to said rear surface, and in the other of said positions said axis is inclined at an angle to said rear surface.

3. An article as defined in claim 1, wherein said insert is constituted by metal and is bendable.

4. An article as defined in claim 1, wherein said body portion is solid, said insert extending from said rear surface to and terminating shortly before said front surface.

5. An article as defined in claim 1; and further comprising at least one further such insert embedded in said body portion and spaced from said first-mentioned insert in a direction transverse to said axis.

6. An article as defined in claim 1, wherein said body portion is hollow and has an outer wall bounding an inner hollow, said insert being embedded in said outer wall.

7. An article as defined in claim 6, wherein said wall is substantially circular; and further comprising a plurality of such inserts in said wall and spaced from each other in a circumferential direction.

8. An article as defined in claim 7, wherein said inserts are squeezable in a direction transverse to said axis so that the shape of said body portion and the dimensions of the latter can be varied.

9. An article as defined in claim 6; and further comprising a plurality of expander members having differing thicknesses, each of said expander members being insertable into said inner hollow of said body portion so as to expand the latter to a dimension corresponding to that of a respective one of said expander members.

10. An article as defined in claim 1; and further comprising an additional portion provided in said body portion and imitating an areola of a natural nipple, said insert and thereby said body portion assuming differing positions relative to said additional portion as well.

11. An article as defined in claim 1; and further comprising means for fixing said body portion in a region adjacent to a user's breast and including a brassiere, said body portion being connected with said brassire, and said insert together with said body portion assume differing positions relative to said brassire as well.

12. An article as defined in claim 10, wherein said body portion has a section located adjacent to said additional portion and being of a smaller cross section than that of the remaining section of said body portion.

* * * * *

UNITED STATES PATENT AND TRADEMARK OFFICE

CERTIFICATE OF CORRECTION

PATENT NO. : 4,227,536

DATED : October 14, 1980

INVENTOR(S) : Marat Shimenkov et al.

It is certified that error appears in the above—identified patent and that said Letters Patent is hereby corrected as shown below:

On The Title Page, address of inventor "Abraham Froyman"

should read -- 110-20 71 Ave., Apt. 308

Forest Hills, N. Y. 11375 --.

Signed and Sealed this

*Third* Day of *March 1981*

[SEAL]

*Attest:*

RENE D. TEGTMEYER

*Attesting Officer*

*Acting Commissioner of Patents and Trademarks*